US005500098A

United States Patent [19]

Brown et al.

[11] Patent Number: 5,500,098

[45] Date of Patent: Mar. 19, 1996

[54] PROCESS FOR REGENERATION OF VOLATILE ACIDS

[75] Inventors: Craig J. Brown, Pickering; Michael A. Sheedy, North York, both of Canada

[73] Assignee: Eco-Tec Limited, Pickering, Canada

[21] Appl. No.: 102,367

[22] Filed: Aug. 5, 1993

[51] Int. Cl.[6] ..... B01D 1/28; B01D 3/34

[52] U.S. Cl. ..... 203/13; 203/12; 203/16; 203/35; 203/36; 203/37; 203/41; 203/42; 203/47; 203/84; 203/85; 203/94; 203/95; 203/98; 203/100; 203/DIG. 8; 159/DIG. 19; 423/394.2; 423/DIG. 1

[58] Field of Search ..... 203/13, 12, 16, 203/15, 35, 33, 36, 41, 42, 37, 84, 85, 47, 96, 92, 93, 94, 98, 95, 97, 100, DIG. 8; 423/DIG. 1, 390.1, 394.2; 159/DIG. 19

[56] References Cited

U.S. PATENT DOCUMENTS

| | | | |
|---|---|---|---|
| 2,993,757 | 7/1961 | Dasher et al. . | |
| 3,383,324 | 5/1968 | Hiwatashi | 423/DIG. 1 |
| 3,401,095 | 9/1968 | Saradzhev | 203/13 |
| 3,443,991 | 5/1969 | Kremm | 423/DIG. 1 |
| 3,840,646 | 10/1974 | Sugimoto et al. . | |
| 4,083,693 | 4/1978 | Hansen | 423/DIG. 1 |
| 4,255,407 | 3/1981 | Puurunen . | |
| 4,526,650 | 7/1985 | Bloomquist et al. . | |

OTHER PUBLICATIONS

"The Regeneration of Nitric and Hydrofluoric Acids from Waste Pickling Liquid" by Hu Delu, et al. Presented at Symposium on Iron and Steel Pollution Abatement Technology for 1980, Philadelphia, Pennsylvania, Nov. 18–20, 1980.

"Iron Removal from Pickle Liquors Using Absorption Resin Technology", Iron Control in Hydrometallurgy, Oct. 19, 1986 by W. K. Munns.

"Vapour–Liquid Equilibria of Nitric Acid–Water–Sulphuric Acid Mixtures", The Journal of Applied Chemistry, 7, Apr., 1957 by S. R. M. Ellis, et al.

*Primary Examiner*—Wilbur Bascomb, Jr.
*Attorney, Agent, or Firm*—Bereskin & Parr

[57] ABSTRACT

Volatile acids containing metal salt impurities, such as metal pickling solutions-are regenerated by a process in which the acid is subjected to sulfuric acid distillation. Resulting volatile acid vapor is condensed and recycled to the pickle tank, while the residual acid mixture is treated in an acid sorption unit, preferably of the acid retardation type. Acid sorbed in the acid sorption unit is periodically eluted with water and recycled, while metal impurities are rejected in a deacidified by-product solution.

15 Claims, 9 Drawing Sheets

PROCESS FOR REGENERATION OF VOLATILE ACIDS

FIELD OF THE INVENTION

This invention relates to the regeneration of volatile acids, for example, acids used in chemical "pickling" solutions.

BACKGROUND OF THE INVENTION

Pickling is the chemical removal of surface oxides or scale from metals by immersion in an aqueous acid solution. For example, solutions containing mixtures of nitric acid and hydrofluoric acid are employed for pickling stainless steels, titanium, zirconium and other metals that are corrosion resistant. These pickling solutions become contaminated with dissolved metals through use. As the metal concentration increases, the free acid concentration decreases and pickling efficiency drops. Additions of fresh concentrated acid are made from time to time to rejuvenate the bath, but eventually it becomes spent and must be discarded.

Although many mineral acids such as sulfuric, hydrochloric and nitric acid are relatively inexpensive, hydrofluoric acid is considerably more expensive, so that disposal of pickle liquors containing fluoride represents a significant loss in terms of the value of the contained fluoride.

Disposal of spent pickling solutions is becoming increasingly difficult and expensive. It is no longer considered environmentally acceptable to discharge spent pickling solution directly into municipal sewers or watercourses and the availability of deep well disposal sites is becoming limited. Discharge of fluoride and nitrate ions is strictly controlled in many regions. Transport of spent pickling solution is also becoming difficult and costly, as spent pickling solution is classified as a hazardous substance whose transport is strictly controlled.

Many pickling operations neutralize spent pickle liquors with an alkali such as sodium hydroxide (caustic soda) or calcium hydroxide (lime). In the case of fluoride containing pickle liquors, calcium hydroxide is usually utilized. Calcium fluoride is only slightly soluble, so that fluoride ions are removed simultaneously with the metal ions, which are precipitated. Unfortunately, neither lime nor sodium hydroxide are effective in removing nitrate ions. The cost of these neutralizing chemicals is considerable and can contribute appreciably to the overall cost of pickling the metal.

Recently, the disposal of the resulting sludges has become a particular concern. These sludges are considered hazardous waste and as such, their disposal has become severely restricted and very expensive. It is becoming widely recognized that a more sensible approach to the problem of disposal of hazardous solid waste is to reclaim the metal values. In the case of metal hydroxide sludges, pyro-metallurgical technology for converting them back to metals is well understood and is being practised today. This approach is particularly attractive for stainless steel pickling operations since sludges emanating from these operations typically contain appreciable quantities of chromium and nickel, which possess significant potential economic value. Unfortunately, the presence of fluoride in these sludges is considered deleterious to the sludge recovery process. As a result, it is not generally feasible to reclaim sludges emanating from pickling operations employing hydrofluoric acid.

DESCRIPTION OF THE PRIOR ART

Various processes have been employed to purify or regenerate (i.e. recover) spent pickling solution. For example, a number of attempts have been made to employ so-called 'sulfuric acid distillation' of spent nitric/hydrofluoric acid pickle liquors. The basis of this process is the fact that nitric and hydrofluoric acids are volatile, while sulfuric acid is not. In this process sulfuric acid is added to the spent pickle liquor, which is then boiled. The sulfuric acid present results in an increase in the vapor pressure of the hydrofluoric and nitric acids present, causing them to evaporate together with the water. Nitrate and fluoride anions displaced from metal salts by the sulfate anion combine with hydrogen ion from the sulfuric acid to form additional nitric acid and hydrofluoric acid, which are also evaporated, leaving behind a sulfate salt solution. When the vapors are condensed, a purified solution of nitric acid and hydrofluoric acid is recovered. An adiabatic absorber column can also be incorporated to partially separate the condensed water vapor from the condensed acids, thereby increasing the concentration of recovered acid.

Operation of the distillation process results in the buildup of metal sulfate salts in the evaporator bottoms. In order for the process to continue functioning, it is normal to maintain the free sulfuric acid concentration in the evaporator greater than 14N (50% $H_2SO_4$) and preferably 18N (60% $H_2SO_4$) through additions of sulfuric acid. Eventually a point is reached where the solubility limit of the metal sulfate salt is reached, whereupon the metal sulfates crystallize out. The solids are filtered out and the recovered sulfuric acid, with a portion of the metal sulfate removed, is recycled back to the evaporator. Thus, this process potentially can achieve the basic objective of recovering a large portion of the waste nitrate and fluoride ions- both free acids as well as metal salts. The metals are rejected as sulfate salts which can be dissolved in water and reprecipitated by neutralization with base. The hydroxide sludge produced can then be disposed of, or possibly reclaimed.

Despite it's obvious potential benefits, the sulfuric acid distillation process has not achieved widespread acceptance. This is because there are a number of problems inherent to the process: As pointed out by Blomquist, crystallization of the nickel and chromium does not occur as readily as iron. These metals are somehow sequestered in solution. In order to deal with this problem, Blomquist utilized a second evaporator operating under a greatly increased temperature (150°–220° C.), high sulfuric acid concentration (80% $H_2SO_4$) and a long residence time to aid in crystallizing these metals. This second evaporator adds greatly to the cost and complexity of the process. It is a difficult task to filter these crystals from such a highly corrosive solution and corrosion resistant equipment for this purpose is very expensive. The crystals are laden with concentrated sulfuric acid. It is not feasible to wash these crystals with water to recover this acid since the salts will redissolve. As a result, the salts are of no commercial value and must be considered hazardous waste.

A large number of ion exchange/sorption systems have been installed over the past few years for recovery of waste stainless steel pickle liquors. These systems are based upon a process known as 'acid retardation'. The acid retardation system uses ion exchange resins which have the ability to sorb acids from solution, while excluding metallic salts of those acids. This sorption is reversible, in that the acid can be readily de-sorbed from the resin with water. It is thus possible, by alternately passing contaminated acid and water through a bed of this resin, to separate the free acid from the metal salt. A similar phenomenon occurs with ion exchange membranes and it is possible to utilize ion exchange membranes in the so-called "diffusion dialysis" process to separate free acid from the metal salts in the same way. Both acid retardation and diffusion dialysis systems may be considered to be 'acid sorption' systems because the mechanisms are very similar.

In the usual acid sorption unit process configuration, contaminated pickling acid flows from the pickle bath to the acid sorption unit or 'ASU'. The acid is removed by the ASU and the metal salt bearing by-product solution exits from the unit. Water is used to elute the acid from the ASU and this acid product flows directly back to the pickle bath.

Both the acid sorption processes have the advantage of being simple and low cost. In addition, with these processes it is possible to operate the pickle tank at any desired concentration of dissolved metal and free acid, so that pickling performance can be optimized. The major disadvantage of these systems is that they generate a by-product or waste stream consisting of a mildly acidic salt solution of the metal being dissolved in the pickling process. This by-product stream must be further treated, usually by neutralization with base, in order to render it harmless to the environment. In the case of stainless steel pickling, where hydrofluoric acid is employed, this by-product stream contains an appreciable quantity of fluoride since some of the metals are strongly complexed by fluoride, as well as a certain concentration of nitrate. The by-product is usually neutralized with lime to remove the fluoride ions as well as the metals. This still leaves a residual of nitrate which may be objectionable in some instances. As discussed above, the presence of fluoride in the sludge may obviate the possibility of pyro-metallurgically reclaiming the metal values from the sludge. Regular additions of concentrated makeup acid are required to replace acid neutralized through metal dissolution. Even when a recovery system of this type is employed, it is normally not possible to reclaim more than about 50% of the fluoride values in the spent pickling solution in the case of pickling of stainless steel with nitric/hydrofluoric acid.

SUMMARY OF THE INVENTION

The object of the present invention is to provide an improved process and apparatus for regeneration of volatile acids containing metal salt impurities.

In its process aspect, the invention involves mixing the volatile acid with sulfuric acid and concentrating the resulting acid mixture in an evaporator in which the volatile acid vaporizes. The volatile acid vapor is condensed to produce a volatile acid solution and the solution is collected. The acid mixture that remains from the evaporation step contains sulfuric acid and metal impurities and is fed to an acid sorption unit in which the acid is sorbed and the metal impurities are rejected in a deacidified by-product solution. Acid sorbed in the acid sorption is eluted with water and the eluted acid is recycled back to the evaporator.

By utilizing sulfuric acid distillation, the present invention provides a means of recovering a high portion of the total nitrate and fluoride values in the spent pickle liquor, but achieves this without encountering the problems inherent in the crystallization step of the prior art processes. The metals are conveniently rejected from the system by the acid sorption unit as a liquid metal sulfate solution which can be subsequently disposed of or reclaimed.

In the acid sorption unit, the acid is preferably sorbed by an ion exchanger which has quaternary amine functional groups and demonstrates a higher preference for nitric acid than sulfuric acid. The ratio of nitrate to sulfate in the by-product solution from the acid sorption unit is then less than the ratio of nitrate to sulfate in the solution fed to the unit. This allows the evaporator to be operated at relatively low sulfuric acid concentrations and temperatures, and high nitrate concentrations while minimizing nitrate losses. As will be explained in more detail later, this offers a number of practical advantages.

An apparatus for regenerating a volatile acid containing metal salt impurity in accordance with the invention includes means for mixing sulfuric acid with the volatile acid, and evaporator means in which the resulting acid mixture concentrated, producing volatile acid vapour. Means is also provided for condensing the volatile acid vapour and producing a volatile acid solution. An acid sorption unit receives the acid mixture from the evaporator and rejects the metal impurities in a deacidified by-product solution. The apparatus also includes means for eluting acid sorbed in the acid sorption unit with water and means for recycling acid eluted from the sorption unit back to the evaporator.

BRIEF DESCRIPTION OF DRAWINGS

In order that the invention may be more clearly understood, reference will now be made to the accompanying drawings which illustrate a number of preferred embodiments of the invention by way of example.

In the drawings.

DESCRIPTION OF PREFERRED EMBODIMENTS

While the process of the present invention is applicable to recovery of many different volatile acids including hydrochloric, nitric, hydrofluoric, acetic etc., which are used to treat a variety of metals including stainless steel, titanium and zirconium, it will be discussed in the context of mixtures of nitric and hydrofluoric acid used to pickle stainless steel, by way of example.

Figure 1:
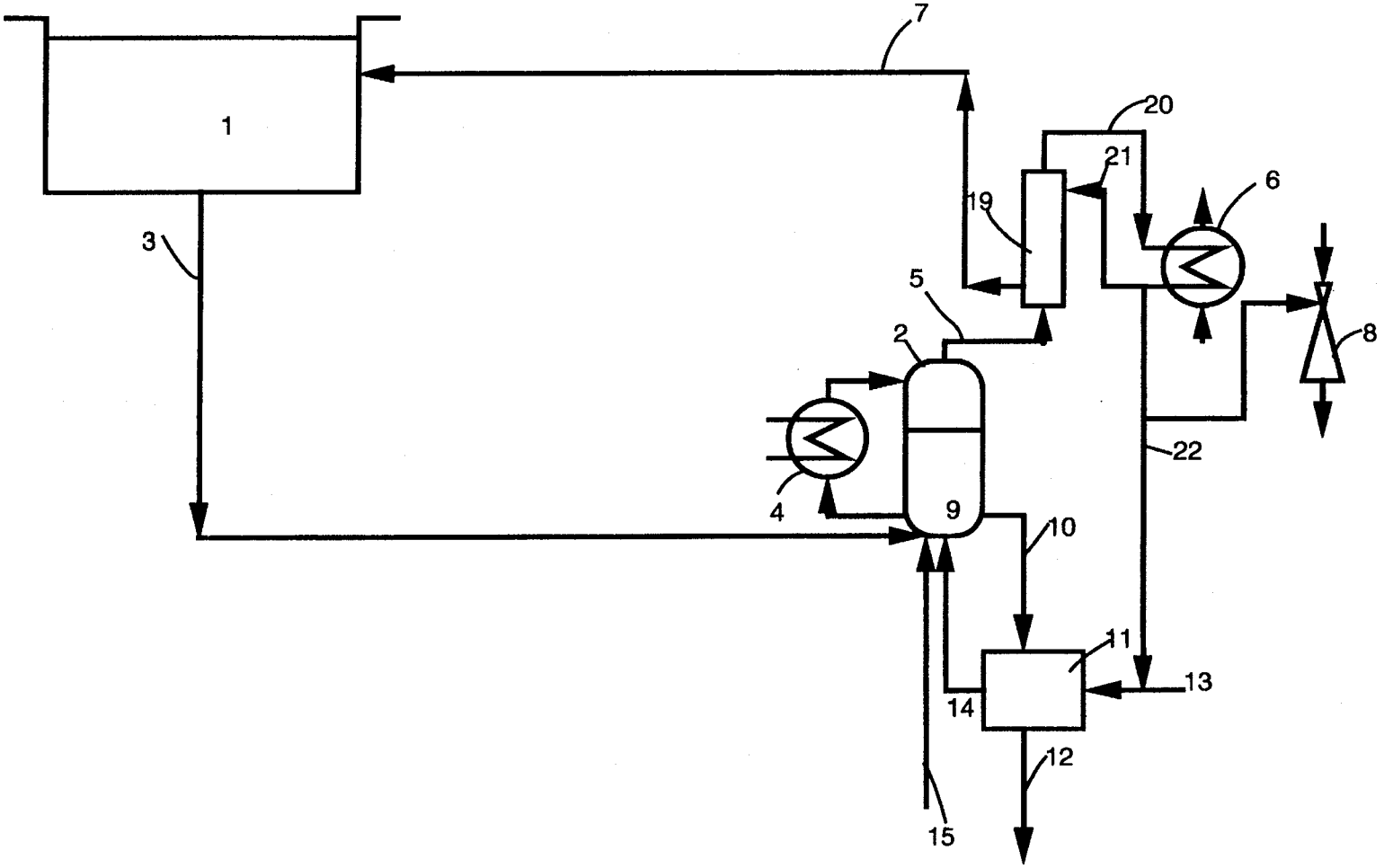
FIGS. 1 to 8 are diagrammatic illustrations of a number of preferred embodiments of the process and apparatus of the invention.

The simplest configuration of the invention is shown in FIG. 1. Spent pickle liquor containing nitric acid, hydrofluoric acid and various nitrate and fluoride metal salts is withdrawn from the pickle bath 1 and passed to an evaporator 2 via line 3. The solution in the evaporator 2 is initially charged with sulfuric acid. By circulating the solution in the evaporator through a heat exchanger 4 energy is supplied, causing water, hydrofluoric acid and nitric acid to vaporize. These acid vapors can flow directly to a condenser where the vapors can be cooled and condensed. However it is preferable to process the vapors leaving the evaporator in an adiabatic absorber. An absorber makes it possible to separate some of the water from the volatile acids, thereby increasing the concentration of the recovered acid.

Vapors from the evaporator are directed via line to the bottom of the absorber column 19. This column can be packed with suitable corrosion resistant packing or fitted with trays as is well known to those skilled in the art. Vapors leaving the top of the absorber column via line 20 are condensed with a heat exchanger 6. A portion of the condensed liquid is recycled or refluxed back to the top of the absorber column via line 21. The condensed vapor or 'overs' from the absorber column will be mainly water with a small concentration of hydrofluoric and traces of nitric acid. Although this water could be discharged after suitable treatment, it can also be recycled to the ASU 11 via line 22 for use in eluting purified acid from the resin bed.

Liquid leaving the bottom of the absorber column will be considerably more concentrated in nitric and hydrofluoric acid than would be the condensate from the evaporator alone, if no absorber column were employed. The acid solution collected from the bottom of the absorber column can be recycled back to the pickle bath via line 7. If the system is operated under a vacuum, non-condensable gases are removed by an ejector 8 or other suitable vacuum producing device.

As with prior art sulfuric acid distillation processes, nitrate and fluoride metal salts are substituted by sulfuric acid, thereby converting these salts to nitric acid and hydrofluoric acid, which are vaporized. The nitrate and fluoride levels in the sulfuric acid contained in the evaporator 'bottoms' 9 will increase until the rate of evaporation of nitric acid and hydrofluoric acid equals the feed rate from additions of spent pickle liquor. The steady-state concentration of nitrate and fluoride depends mainly on the sulfuric acid concentration. Increased sulfuric acid concentration will tend to decrease the nitrate and fluoride levels. Prior art processes typically operate at a sulfuric acid concentration of about 18N (60% $H_2SO_4$). While the present invention can be operated under these conditions, it is possible to operate at a considerably lower sulfuric acid concentration due to a previously unknown phenomenon that occurs in acid sorption units of the type discussed herein.

When the dissolved metal concentration in the evaporator has reached a predetermined upper limit, solution is withdrawn from the evaporator 2 and passed via line 10 to an acid sorption unit 11. This ASU can be of either the acid retardation type such as the Eco-Tec APU® or the membrane (i.e. diffusion dialysis) type such as that supplied by Tokuyama Soda and Asahi Glass, although the acid retardation type is preferred because of the more robust nature of the resins compared to the membranes. The free acid present in the solution fed to the ASU is sorbed by the resin bed, while the salt passes through the bed and is collected from line 12 as a waste or by-product solution. The free acid content of the by-product is substantially lower than the free acid content of the solution fed to the ASU. Water (either fresh or condensate from the absorber) is next admitted to the ASU bed via line 13 and this water elutes acid from the resin and produces an acid product which is collected from line 14 and recycled back to the evaporator. The metal content in this acid product is significantly lower than that in the solution fed to the ASU.

Thus the ASU provides a means of removing metal sulfates from the evaporator other than the crystallization process which is employed by the prior art processes. Unlike the crystallization process, the ASU is equally effective for removal of all the metals including iron, chromium and nickel. Moreover, unlike the crystallization process, the metal concentration chosen has no lower limit when the ASU is employed. It works equally well on dilute or concentrated solution, although as will be discussed, there are advantages in maximizing the metal concentration. Thus the ASU can be the sole means of removing metal from the evaporator or it can be used to supplement a crystallizer, to remove metals such as nickel and chromium which are not efficiently removed by the crystallizer.

As with the prior art distillation process, sulfuric acid is consumed by the process in converting the nitrate and fluoride salts to sulfates, which in this invention are rejected via the ASU by-product. In addition, there is a low residual concentration of free sulfuric acid in the ASU by-product due to the inefficiency of the process. Fresh, concentrated sulfuric acid must therefore be added to the evaporator via line 15 to maintain the sulfuric acid concentration at a steady level.

As mentioned above, there will be a steady-state concentration of nitrate in the evaporator solution 9 which is fed to the ASU. The concentration of nitrate will be appreciable, particularly at lower evaporator sulfuric acid concentrations and temperatures. One would expect that the ratio of nitrate to sulfate in the ASU by-product to be essentially the same as that in the feed solution. For example, if the ASU feed contains a total sulfate concentration of 600 g/L and a nitrate concentration of 20 g/L (i.e. a ratio of 0.033), and if the total sulfate concentration in the ASU by-product was 40, one would expect the nitrate concentration in the by-product to be approximately $0.033 \times 40 = 1.32$ g/L. This would be highly undesirable because not only would this represent a significant economic loss but if the by-product discharged to the environment after neutralization, the nitrate levels would be a troublesome pollutant. This problem would be exacerbated at lower operating sulfuric acid concentrations and temperatures where the nitrate concentration in the feed would be higher.

It has been discovered however, that contrary to what one would anticipate, when an anion exchanger with quaternary ammonium functional groups is employed in the ASU, the ratio of nitrate to sulfate in the ASU by-product is appreciably lower than that in the feed. It would appear that when utilized in this process, such an anion exchanger has a higher preference for nitrate than sulfate. This is in contrast to its behaviour in ion exchange demineralization processes where this type of ion exchanger has a marked preference for sulfate over nitrate. As a result, the loss of nitrate in the ASU by-product is very low, even if the concentration in the solution fed to ASU is relatively high. Because of this, it is possible to operate the evaporator at relatively low sulfuric acid concentrations, while minimizing nitrate losses. The advantage of operating at low sulfuric acid concentration and the significance of this selectivity phenomenon will now become apparent.

Figure 9:
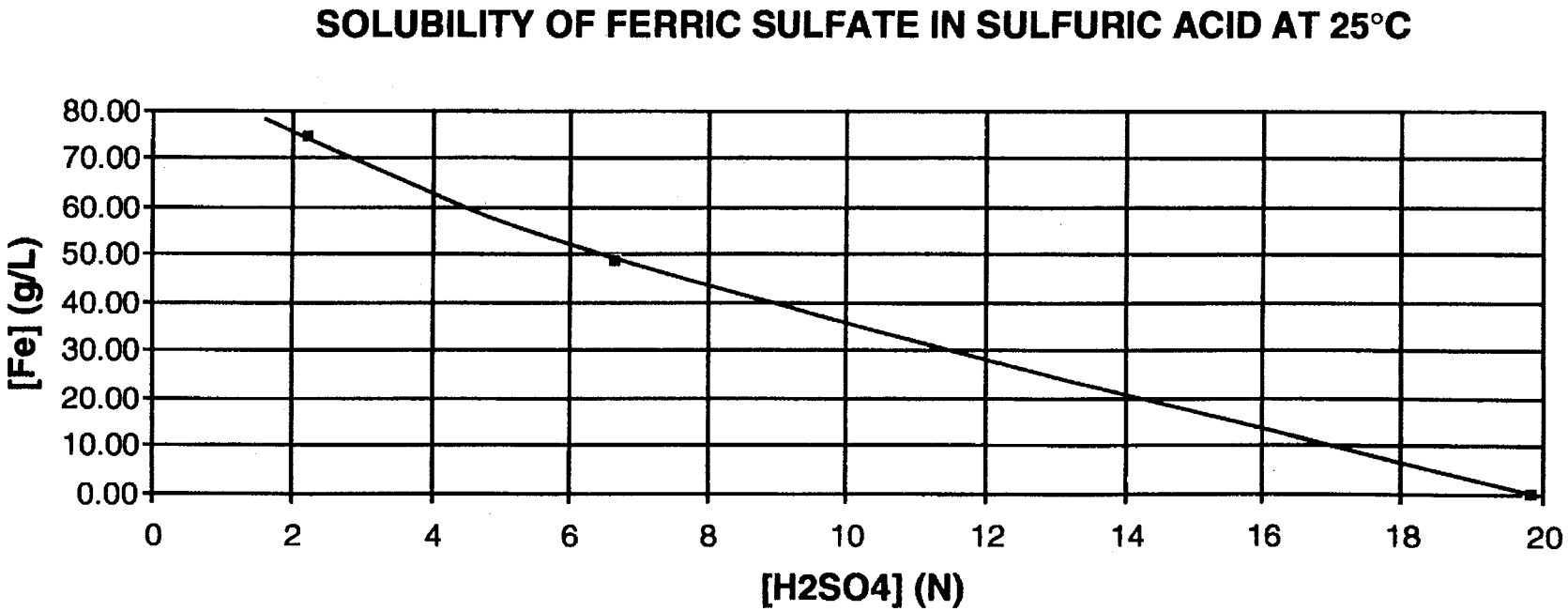
FIG. 9 is a graph showing the solubility of ferric iron at 25° C. as a function of sulfuric acid concentration.

Unlike prior art processes, this invention is based upon keeping the iron in solution and avoiding crystallization. As shown in FIG. 9, the solubility of iron is inversely related to the sulfuric acid concentration. Operating at lower sulfuric acid concentrations in the evaporator therefore allows for operation at higher iron concentrations. This will minimize the flow that must be treated by the ASU to remove a given quantity of iron and so minimize its size and capital cost. The concentration of free acid in the by-product is normally independent of the iron concentration so that operation at higher iron levels will help reduce the loss of sulfuric acid. Moreover, operation at lower sulfuric acid feed concentrations will further minimize the amount of free acid lost in the byproduct, since the concentration of the acid in the byproduct is directly related to the feed concentration. Low sulfuric acid concentration will increase the nitric acid concentration in the evaporator solution and the solution fed to the ASU. However the anticipated high loss of nitrate is reduced by the unexpected nitrate selectivity of the resin.

Figure 2:
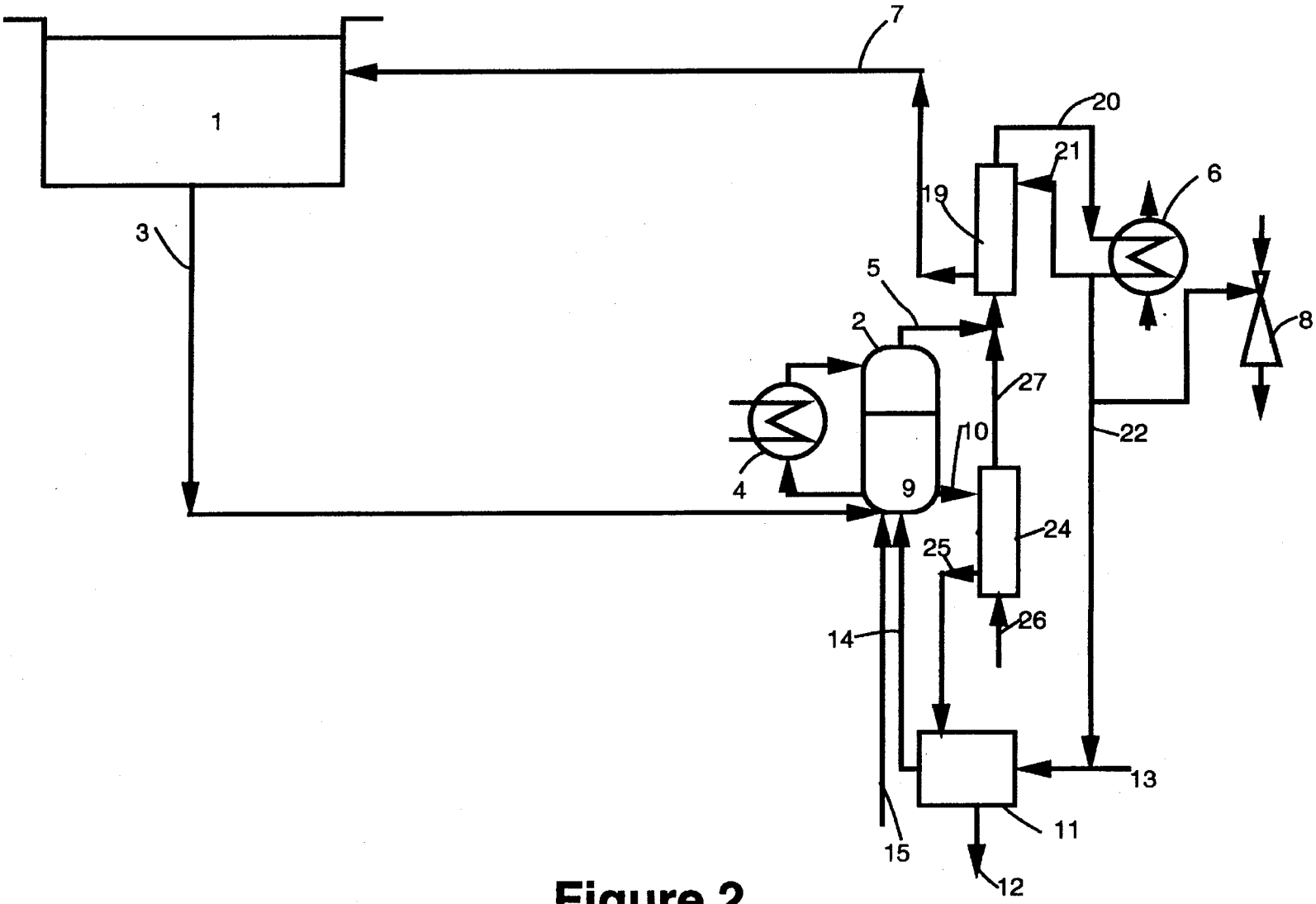

Operating the evaporator at lower sulfuric acid concentrations also causes the steady state concentration of fluoride in the evaporator solution feeding the ASU to be higher. Unfortunately, in contrast to its behaviour with nitrate, the by-product from the ASU has been observed to have a higher fluoride to sulfate ratio than the feed solution. Operation at low sulfuric acid concentrations will therefore diminish the fluoride recovery efficiency of the process. The embodiment illustrated in FIG. 2 provides a means to reduce the fluoride concentration in the ASU feed and increase fluoride recovery and overcome this disadvantage. According to this embodiment, solution is withdrawn from the evaporator and passed via line 10 to the top of a packed stripper column 24 wherein the solution is contacted with steam which is admitted via line 26 to the bottom of the stripper column. The solution leaving the bottom of the stripper column is reduced in fluoride concentration and then passed to the ASU. The stripper is also effective in removing nitrate from the ASU feed solution so that the level of both fluoride and nitrate in the ASU by-product ultimately going to waste can be further reduced.

The steam leaving the top of the stripper column, now bearing hydrofluoric and nitric acid which has been stripped from the solution being fed to the ASU, is next directed to the absorber column via line 27 where the acid values are separated from the water vapours.

Figure 3:
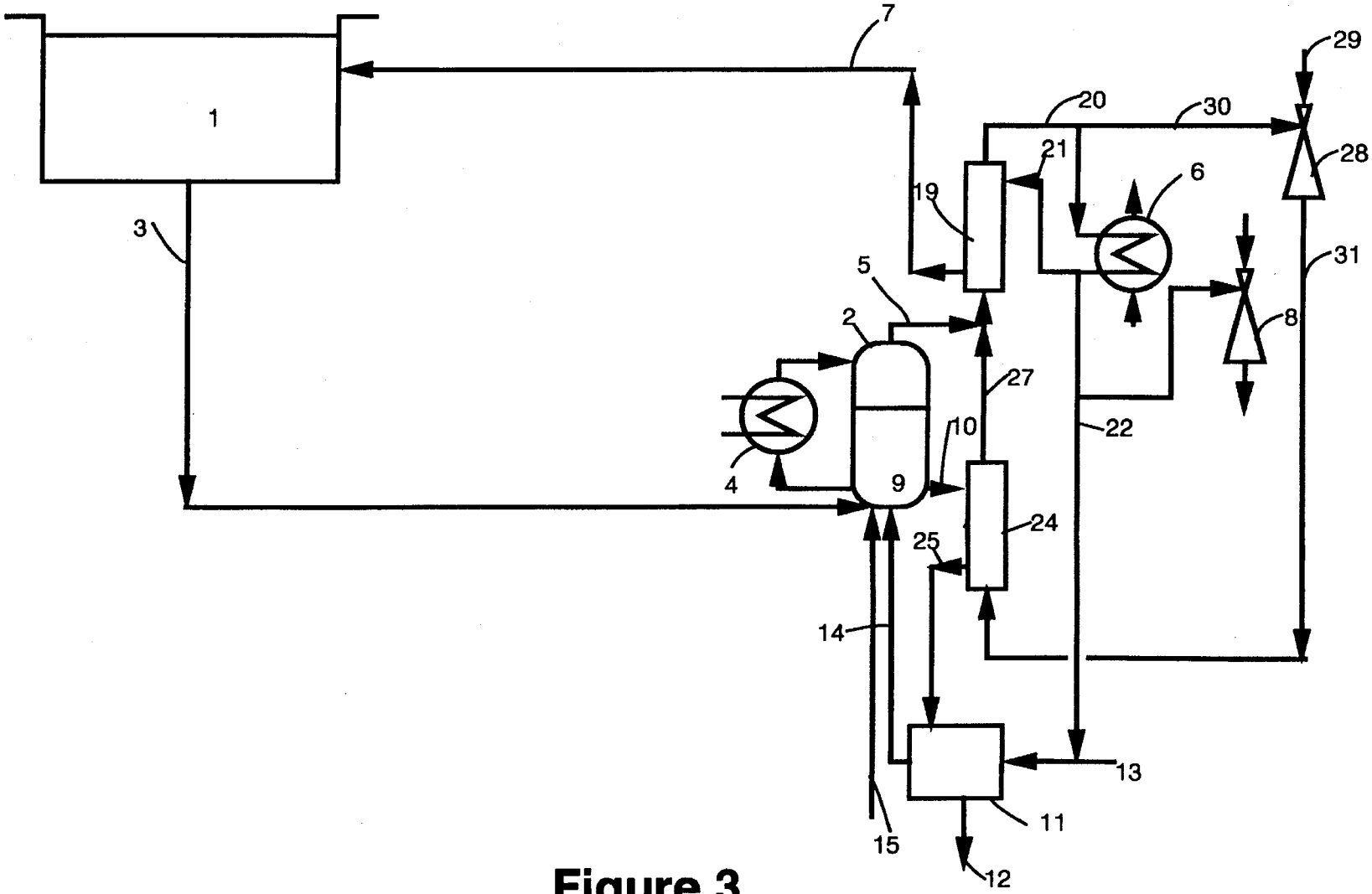

The steam used in the stripper can be fresh steam from a separate boiler, however this will appreciably increase the energy requirement of the process. In a preferred embodiment shown in FIG. 3, a mechanical compressor or steam jet compressor 28 is employed to recompress a portion of the vapor leaving the top of the absorber 30. This vapor is passed via line 31 to the stripper which is used in place of virgin steam to strip hydrofluoric and nitric acid from the solution to be fed to the ASU. By this means the amount of steam consumed in the stripper can be reduced by typically up to 75%.

If the sulfuric acid concentration in the evaporator is maintained greater than 12N it is possible to reduce the amount of fluoride contained in the ASU by-product to less than 10% of the fluoride fed to the system. If the sulfuric acid concentration is less than 10N however, the loss of fluoride in the ASU by-product will significantly exceed 10% and probably be unacceptable. Beyond a concentration of 15N, the solubility of ferric sulfate is too low and frequent problems with crystallization will be experienced. As a result the sulfuric acid concentration in the evaporator should be between 10–15N and preferably 12–15N. It will be noted that this acid concentration is significantly lower than prior art sulfuric acid distillation processes which typically operate at about 18N (60% $H_2SO_4$).

The absorber 19 is designed to yield a vapor 20 and subsequently a condensate 21 containing a low level of hydrofluoric acid. Although as suggested above, the condensate can be reused by the ASU for acid elution, because this stream contains some hydrofluoric acid, this will result in an increase in the fluoride concentration in the ASU by-product. This will consequently reduce the overall fluoride recovery efficiency of the system. The hydrofluoric acid concentration in the condensate can be reduced by increasing the length of the absorber, however there are practical and economical limits to how large it can be made.

Figure 4:
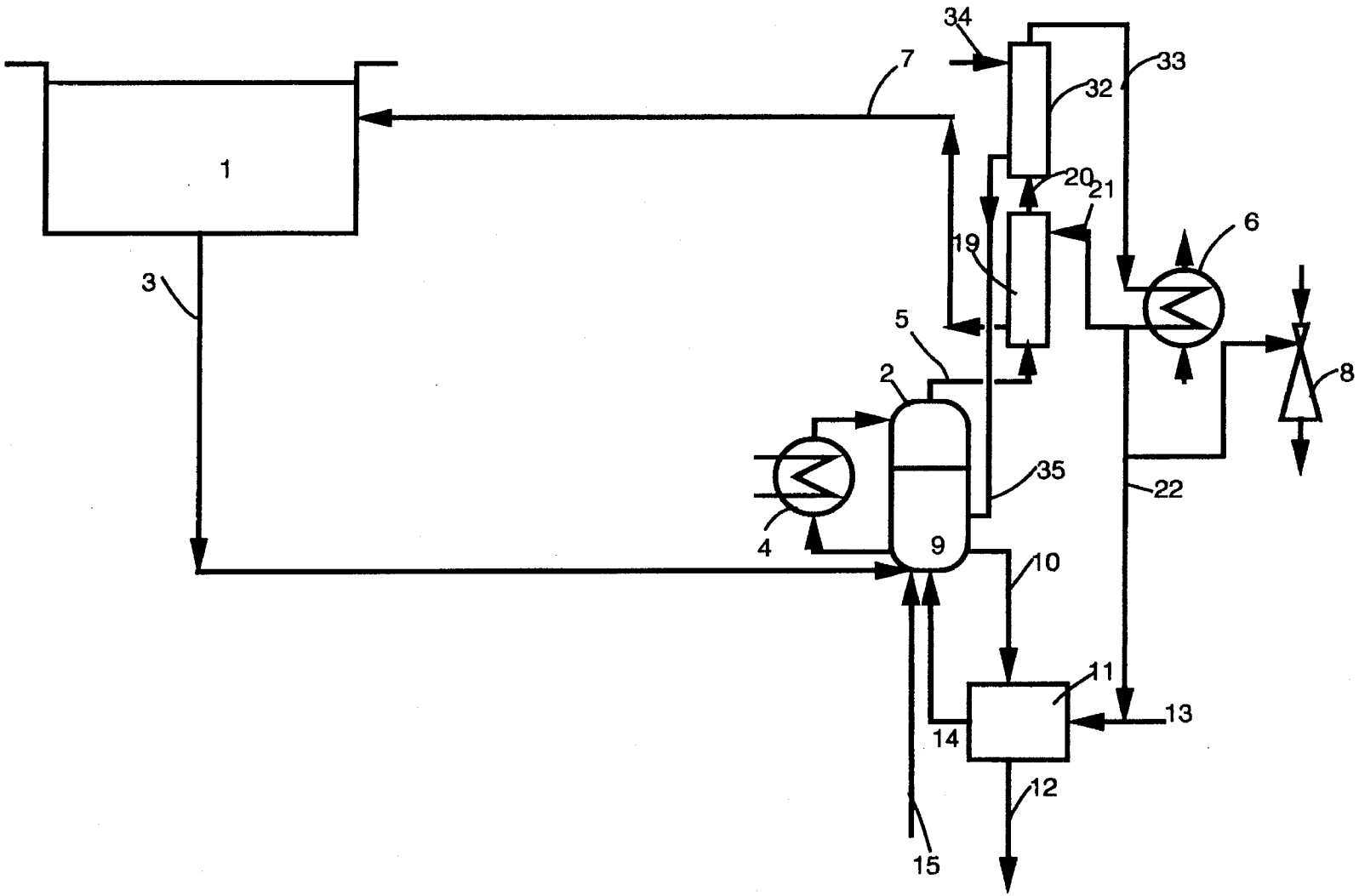

In an alternative arrangement shown in FIG. 4 the vapors leaving the absorber via line 20 are passed through a scrubber 32 wherein these vapors are contacted with a dilute base such as sodium, potassium or ammonium hydroxide which is admitted to the scrubber via line 34. The base will very effectively remove any residual acid, thereby yielding a vapor and condensate with extremely low levels of acid. The vapors leaving the scrubber are then passed to the condenser 6 via line 33. When the base used in the scrubber liquor has been become spent due to reduction in alkalinity or increase in fluoride concentration, the spent base can be passed via line 35 to the evaporator 9. The fluoride will be recovered in the evaporator and the resulting sodium or potassium sulfate will be rejected from the system by the ASU. By this means the fluoride recovery efficiency of the system can be improved.

Figure 5:
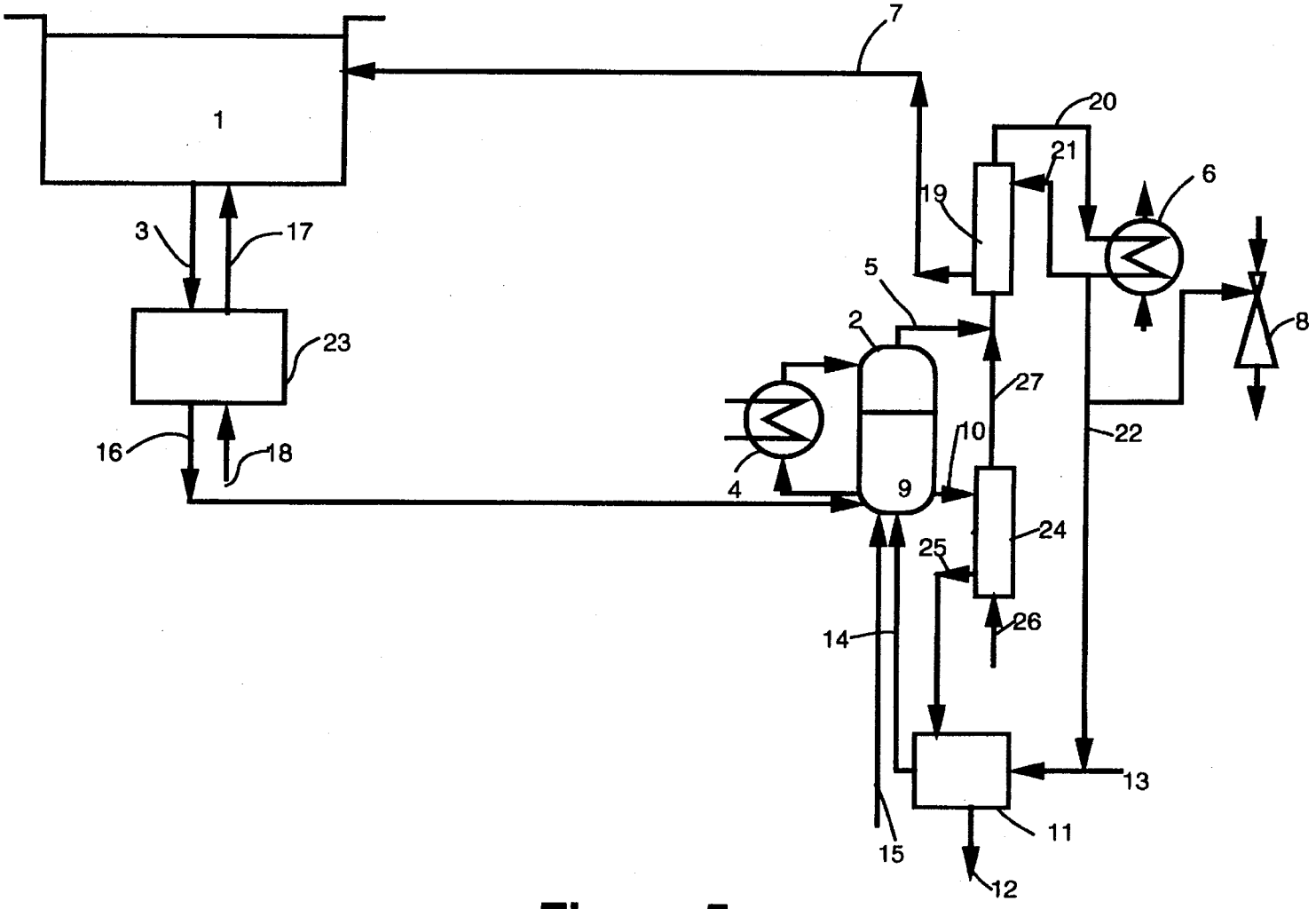

As discussed above, a large number of acid sorption units have already been installed on pickling baths to recover the free acid values. The embodiment of the invention in FIG. 5 illustrates how the present invention can be employed to recover the nitrate and fluoride values contained in the metallic salt by-product from these units. In this case, spent pickle liquor is fed to a second ASU 23 via line 3. Water 18 elutes purified acid product from the ASU and this acid is recycled directly back to the pickle bath via line 17. The deacidified metal salt by-product containing metal nitrate and fluoride salts with a small amount of free acid is collected from the ASU and flows via line 16 to the evaporator. The evaporator can be equipped with an absorber, stripper and scrubber as previously described to obtain the advantages outlined above.

Figure 6:
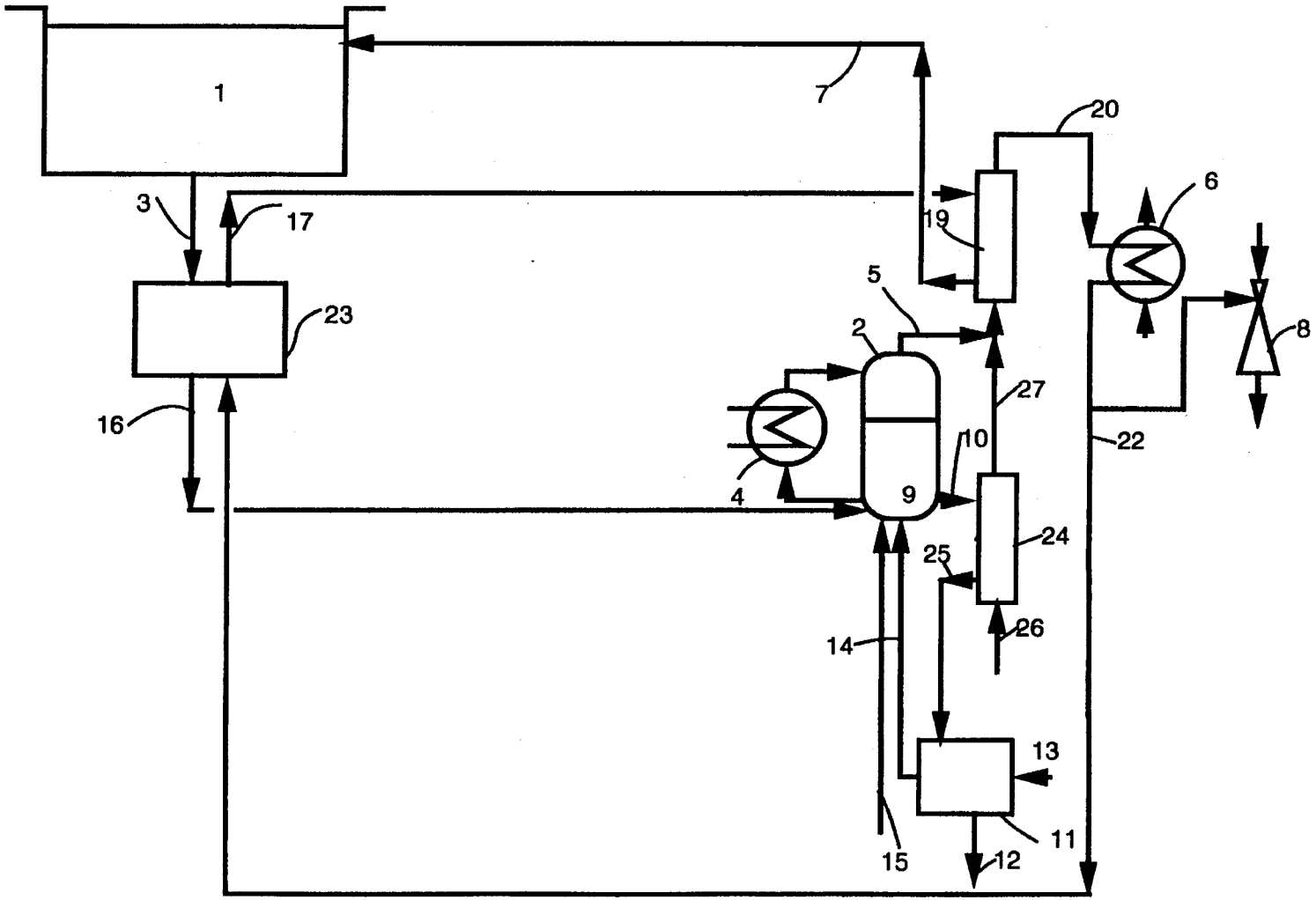

The total volume of recovered acid from the ASU and the evaporator/absorber may be greater than the volume of spent pickle liquor withdrawn from the pickle bath. Operation in this manner could cause the pickle bath to overflow, depending upon the amount of water losses from the pickle bath. To avoid this, in a slightly modified embodiment shown in FIG. 6, the acid product from the second ASU can be employed as reflux to the absorber column via line 17 in lieu of condensate from the column. The condensate from the condenser 6 line 22, which will contain minor concentrations of nitric acid and hydrofluoric acid, can be optionally utilized by the second ASU for acid elution as shown.

It will be appreciated that the solutions processed by the evaporator are extremely corrosive and the materials of construction must be carefully chosen. It is necessary to employ materials such a fluorocarbon plastics (e.g. TFE and PVDF) and graphite which are very expensive. In fact, several of the prior art inventions are specifically directed towards ways of minimizing corrosion. Because in this invention it is possible to operate at lower sulfuric acid concentrations with lower boiling points, corrosion problems will be somewhat alleviated.

Figure 7:
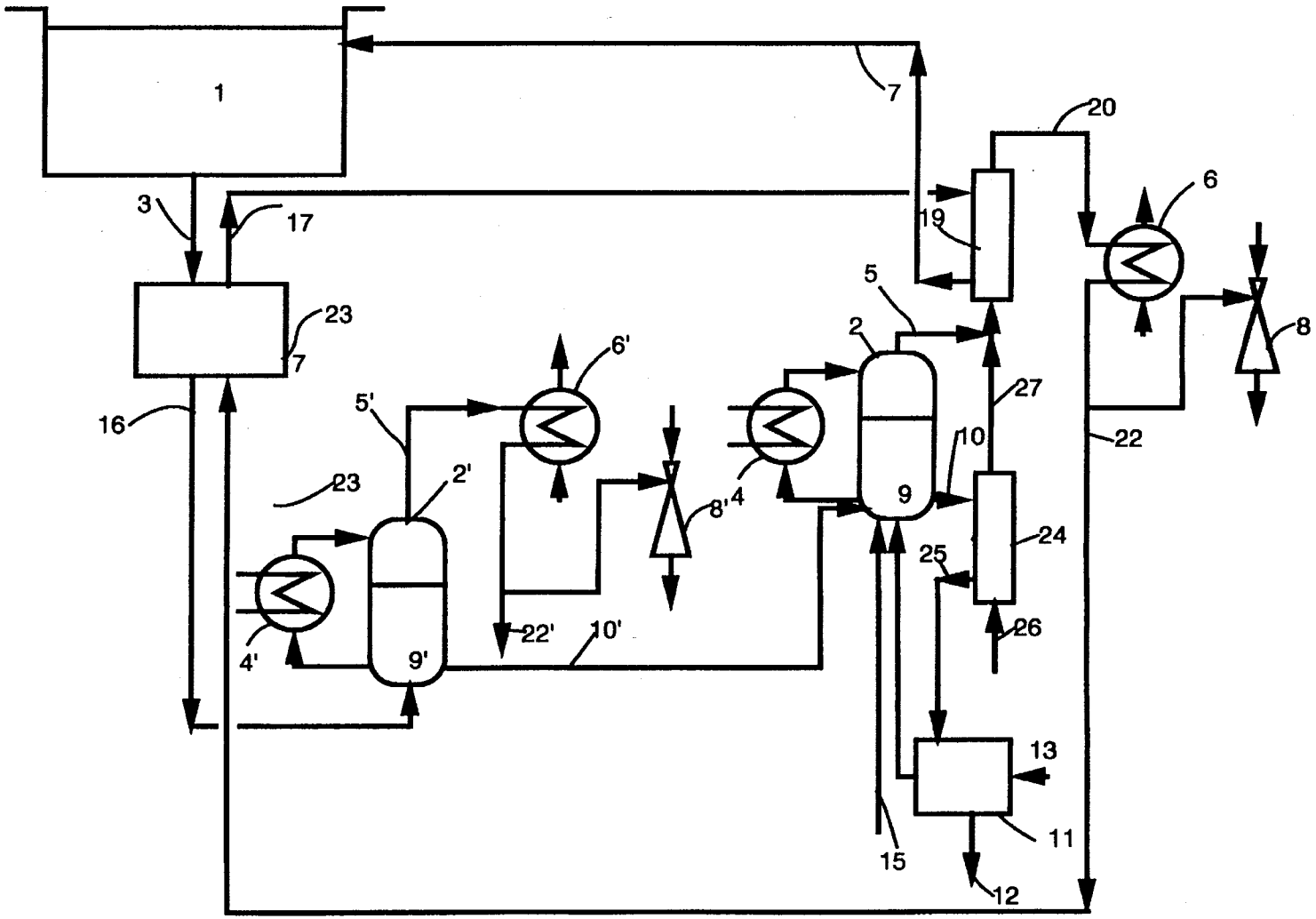

In a further embodiment of the invention shown in FIG. 7, the evaporation is accomplished in two stages to further reduce the cost of the evaporation equipment. A second ASU 23 is connected directly to the pickle bath as above. The by-product from the second ASU is directed via line 16 to the second evaporator 2'. This second evaporator is not fitted with an absorber or stripper and no sulfuric acid is utilized. Because of the low free acid content of the solution in the second evaporator, it is significantly less corrosive, so that less exotic materials of construction can be employed such as stainless steel.

The vapors leaving the second evaporator via line 5' are condensed in a second condenser 6'. Because of the low acidity of the feed to the second evaporator, this condensate 22' contains only a very small quantity of acid and can be recycled back to the ASU for use as an eluent in lieu of water or discharged. The ASU by-product can be concentrated in this second evaporator several fold, at which point it is passed via line 10' to the first evaporator 2. This solution should be transferred while it is still hot to avoid crystallization, if it is concentrated beyond the room temperature solubility limit. Sulfuric acid is employed in the first evaporator as above, causing nitric and hydrofluoric acid to evaporate along with water vapour from the top of the evaporator. This vapor can be condensed directly, the resulting acid being recycled back to the pickle bath or it can be passed through an absorber column 19 as described later above and shown in FIG. 4, to obtain a more concentrated acid solution and avoid potential overflow problems. A stripper can also be employed to maximize fluoride recovery.

To further minimize the corrosiveness of the solution processed by the second evaporator, base such as potassium hydroxide can be added to the by-product 16 to neutralize the free acidity. This will also have the beneficial effect of totally eliminating vaporization of acid and increasing the purity of the water condensed. Care must be taken not to add excessive base as this will cause metals to precipitate from the solution. Potassium or ammonium hydroxide are preferable to sodium hydroxide because their fluoride salts have higher solubilities. The metallic cations from the added base (e.g. $K^+$) will ultimately be removed from the first evaporator by the first ASU. If a scrubber is installed as shown in Figure 4, the spent base from the scrubber could advantageously be fed to the second evaporator. Any available base contained therein would serve to neutralize the acidity in the by-product from the second ASU which is also fed to the second evaporator.

Figure 8:
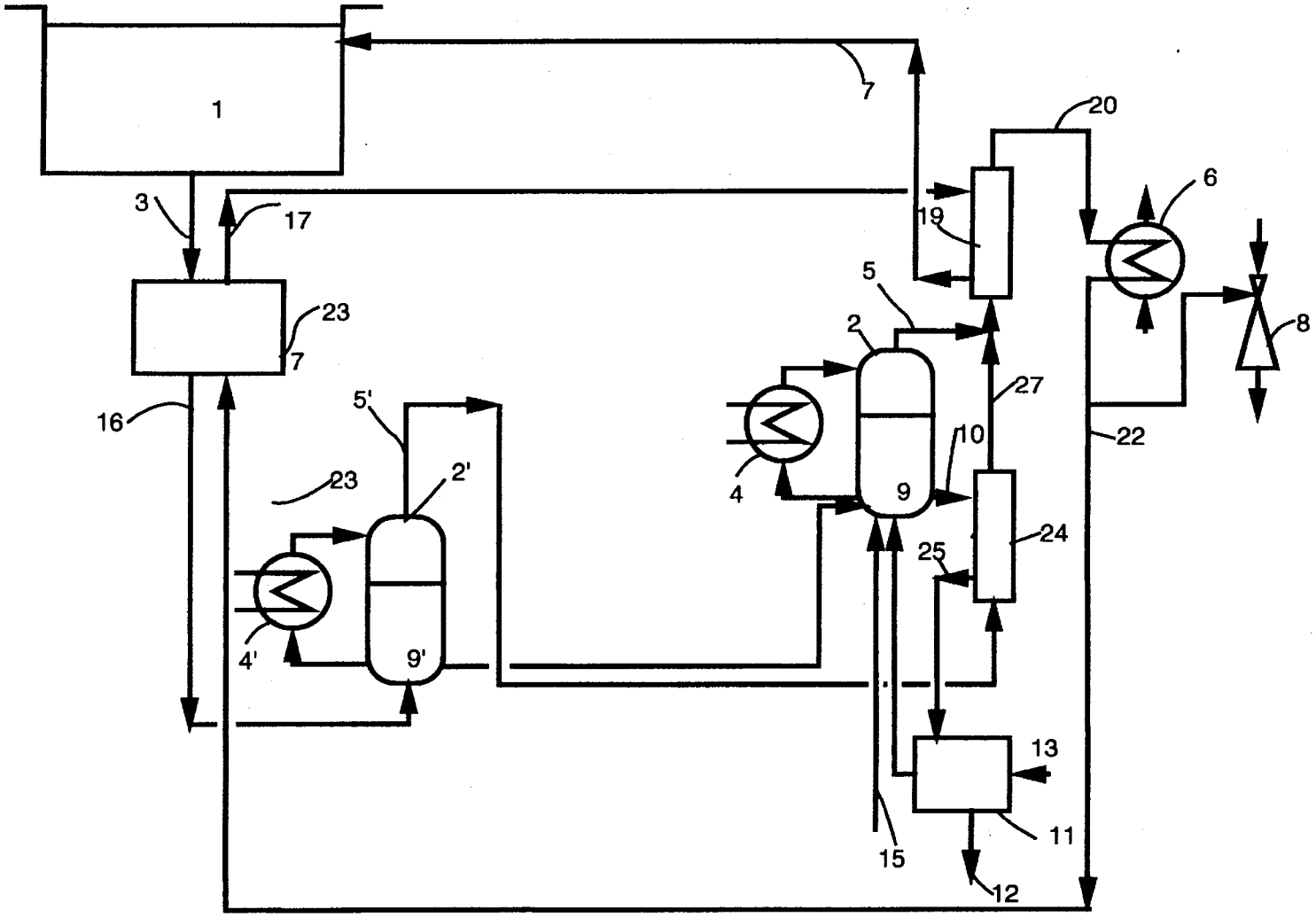

In yet another embodiment of the invention shown in FIG. 8, the vapors leaving the second evaporator 5' which contain no acid vapors, can be employed in the stripper 24 in lieu of fresh steam. This provides another means of minimizing the energy consumption of the process.

It would also be possible to recover rinsewaters by concentrating them in the second evaporator in a similar manner to that described for by-product from the second ASU, providing the final concentration was not so high as to volatilize appreciable quantities of acid.

Various alternatives present themselves for treatment of the metal salt by-product from the first ASU which contains the metallic impurities originally generated in the pickle bath. The most straight forward would be to simply neutralize this stream with a base such as sodium hydroxide. This would generate metal hydroxide sludge containing very low fluoride levels which could be disposed of in a suitable hazardous waste land-fill site or possibly be recycled to an electric reduction furnace to recover the metal values. Sodium hydroxide will not remove any residual fluoride which may be contained in this solution however. In order to effectively remove fluoride it is necessary to utilize lime for neutralization. It may be considered advantageous to separate the metals in this stream to facilitate their reclamation. For example it may be preferable to recover the nickel without the presence of large quantities of chromium. Various selective precipitation reagents such as phosphate, sulfide and ammonia can be employed for this purpose although the details are outside of the scope of this invention.

While the above description relates to regeneration of nitric/hydrofluoric acid stainless steel pickle liquors, the invention can be employed for any volatile acid or combination of such acids, including nitric, hydrofluoric, hydrochloric or acetic. Thus, the term "volatile acid" as used herein may denote a combination or mixture of a number of acids. The process of the invention can be used to regenerate acids containing a variety of metals as impurities, including iron, chromium, nickel, molybdenum, vanadium titanium, zirconium, magnesium etc. The invention is not restricted to the treatment of acids used for pickling. The regenerated acid need not be recycled as illustrated, but may be collected and used for other purposes.

It should also be noted that the process of the invention may be operated continuously or batch-wise. For example, in a process for regenerating pickle liquor, the liquor could be withdrawn continuously or batch-wise from the pickle tank, and delivered to the evaporator which would then operate in corresponding fashion. Normally, an acid sorption unit of the acid retardation type would operate cyclically or intermittently with the resin being periodically eluted with water, while a diffusion dialysis process would operate continuously. It should be noted, however, that continuous ion exchange systems of the acid retardation type are available.

Mixing of the sulfuric acid with the volatile acid will normally take place in the evaporator in which the resulting acid mixture is concentrated. However, the sulfuric acid could be premixed with the volatile acid upstream of the evaporator.

The process of the invention is illustrated by the following examples:

EXAMPLE 1

A recovery system basically as shown in Figure 2 was assembled. In this case the heat exchanger 4 was electricity fired. A synthetic stainless steel pickle liquor containing nitric acid, hydrofluoric acid and salts of iron, chromium and nickel was prepared as shown in Table 1 and fed to the system. The system was operated for several hours and solutions were collected over approximately three hours of operation and analyzed. The results are summarized in Table 1.

TABLE 1

| Stream Description | Volume Processed (L) | [Fe] (g/L) | [Ni] (g/L) | [Cr] (g/L) | Total Metal (g/L) | [F] (g/L) | [$NO_3$] (g/L) | [$SO_4$] (g/L) | [H] (N) |
|---|---|---|---|---|---|---|---|---|---|
| pickle liquor (in) | 1.73 | 27.95 | 5.15 | 6.45 | 39.6 | 56.55 | 185.8 | | 3.12 |
| evaporator | | 18.45 | 2.85 | 3.10 | 24.4 | 10.91 | 48.9 | 705 | 14.3 |
| condensate (out) | 4.11 | | | | | 3.48 | <0.2 | | 0.16 |
| abs. bottoms (out) | 0.94 | | | | | 42.84 | 210.3 | 9.5 | 5.25 |
| ASU feed (in) | 5.85 | 12.02 | 2.05 | 2.15 | 16.2 | 3.52 | 16.3 | 630 | 12.1 |
| ASU by-product (out) | 3.74 | 7.27 | 1.45 | 1.5 | 10.2 | 1.12 | <0.5 | 34.0 | 0.30 |
| stripper steam | 2.6 kg | | | | | | | | |

TABLE 1-continued

| Stream Description | Volume Processed (L) | [Fe] (g/L) | [Ni] (g/L) | [Cr] (g/L) | Total Metal (g/L) | [F] (g/L) | [$NO_3$] (g/L) | [$SO_4$] (g/L) | [H] (N) |
|---|---|---|---|---|---|---|---|---|---|
| (in) | | | | | | | | | |
| 93% sulfuric acid (in) | 0.191 | | | | | | | 1660 | 34.6 |

evaporator pressure = 22.5 inches vacuum
evaporator temperature = 8.1° C.

From the composition of the pickle liquor shown in Table 1 it can be calculated that if the pickle liquor were disposed of directly, approximately 4.7 grams of nitrate and 1.43 grams of fluoride would be lost for each gram of metal removed. On the other hand, the amount of nitrate and fluoride lost in the ASU by-product represents only <0.05 and 0.11 grams respectively, per gram of metal removed. These quantities are only <1% of the nitrate and 7.7% of the fluoride that what would be lost if the pickle liquor were disposed of directly. If the condensate were discharged to waste the additional loss of nitrate and fluoride would be <0.02 and 0.37 grams respectively, per gram of metal removed. It would be highly desirable if the fluoride ions in the condensate could be recovered or reduced.

It can be seen that the ratio of nitrate to sulfate in the ASU feed is 0.0258 while the ratio of nitrate to sulfate in the ASU by-product is <0.0147. This illustrates that the ASU selectively recovers nitric acid over sulfuric acid.

The ratio of fluoride to metal in the evaporator (i.e. prior to treatment by the stripper) is 0.447, while ratio of fluoride to metal in the ASU feed (i.e. after the stripper) is 0.217, a reduction of 51.5%. This shows that the stripper is effective in removing hydrofluoric acid.

The ratio of nickel to iron in the ASU by-product (0.20) is approximately equal to the nickel to iron ratio in the pickle liquor (0.18). This shows that unlike prior art sulfuric acid distillation processes which employ crystallizers, the ASU is equally effective in removing nickel and iron.

EXAMPLE 2

A scrubber was installed on the system of example 1 as shown in FIG. 4. A solution of dilute potassium hydroxide was circulated through the scrubber. The system was operated for several hours and solutions were collected over approximately 1 hour of operation and analyzed. The scrubber liquor bleedoff was not recycled to the evaporator in this case. The results are summarized in Table 2. Nitrate and fluoride values were not determined in this case.

TABLE 2

| Stream Description | Volume Processed (L) | Total Metal (g/L) | [F] (g/L) | [H] (N) |
|---|---|---|---|---|
| pickle liquor (in) | 0.644 | 56.55 | 185.8 | 3.12 |
| evaporator | | 20.2 | 7.06 | 14.7 |
| condensate (out) | 1.30 | | 0.06 | pH = 2.7 |
| absorber bottoms (out) | 0.93 | | | 4.31 |
| ASU feed (in) | 4.23 | 12.82 | 2.67 | 12.3 |
| ASU by-product (out) | 2.70 | 8.54 | 0.93 | 0.321 |
| stripper steam (in) | 1.25 | | | |

TABLE 2-continued

| Stream Description | Volume Processed (L) | Total Metal (g/L) | [F] (g/L) | [H] (N) |
|---|---|---|---|---|
| 93% sulfuric acid (in) | 0.076 | | | 34.6 |
| scrubber liquor (out) | 0.54 | | 4.81 | pH = 12.9 |

evaporator pressure = 19.5 in. vacuum
evaporator temperature = 92.1° C.

The results in Table 2 show that the fluoride concentration of the condensate collected (0.06 g/) was substantially lower than in example one when no scrubber was employed (3.48 g/L), indicating that the scrubber was effective in increasing the purity of the condensate collected, while the system was still effective in regenerating the spent pickle liquor.

We claim:

1. A process for regeneration of a volatile acid containing metal salt impurities, comprising the-steps of:

(a) mixing said volatile acid with sulfuric acid to form an acidsmixture;

(b) concentrating the acid mixture in an evaporator to produce a concentrated acid mixture and and acid vapor;

(c) condensing said acid vapor resulting from step (b) to produce a volatile acid solution, and collecting said solution;

(d) feeding the concentrated acid mixture from step (b) to an acid sorption unit in which acid is sorbed from said mixture and metal impurities in the mixture are rejected in a deacidified by-product solution;

(e) eluting acid sorbed in said acid sorption unit with water; and, (f) recycling acid eluted from said sorption unit back to said evaporator.

2. A process as claimed in claim 1, wherein said volatile acid contains nitric acid.

3. A process as claimed in claim 1, comprising the further steps of:

processing the acid vapor resulting from step (b) in an adiabatic absorber prior to performing step (c), to yield a vapor and an acid solution;

subjecting said vapor to said condensation step (c); recycling a portion of the volatile acid solution collected from step (c) to said absorber; and, collecting the acid solution yielded by the absorber.

4. A process as claimed in claim 1, comprising the further step before step (a) of pre-concentrating said volatile acid in a second evaporator.

5. A process as claimed in claim 1, wherein the volatile acid is an acid pickling solution contained in a pickle tank, from which spent solution is removed for said regeneration, and wherein said volatile acid solution collected from step (c) is recycled to said pickle tank.

6. A process for regeneration of a volatile acid containing metal salt impurities, comprising the steps of:

(a) mixing said volatile acid with sulfuric acid to form an acid mixture;

(b) concentrating the acid mixture in an evaporator, to produce a concentrated acid mixture and acid vapor;

(c) processing the acid vapor resulting from step (b) in an adiabatic absorber to yield a vapor and a volatile acid solution;

(d) condensing the vapor from the adiabatic absorber to produce a dilute acid solution;

(e) recycling a portion of said dilute acid solution to said absorber;

(f) collecting the volatile acid solution yielded by the absorber;

(g) treating the concentrated acid mixture from step (b) in a steam stripping vessel to remove residual volatile acid and produce a volatile acid laden steam;

(h) processing said volatile acid laden steam in said adiabatic absorber;

(i) feeding the concentrated acid mixture from the steam stripping vessel to an acid sorption unit in which acid is sorbed from said mixture and metal impurities in the mixture are rejected in a deacidified by-product solution;

(j) eluting acid sorbed in said acid sorption unit with water; and, (k) recycling acid eluted from said sorption unit back to said evaporator.

7. A process as claimed in claim 6, comprising the further step of contacting said vapor yielded by the absorber in a scrubber with a base to remove residual acid in said vapor, prior to said step of condensing the vapor.

8. A process as claimed in claim 7, wherein spent base containing fluoride is produced in said scrubber and is recycled back to the evaporator.

9. A process as claimed in claim 6, wherein the acid concentration in said evaporator is maintained at less that 15N and greater than 10N.

10. A process as claimed in claim 9, wherein the acid concentration in said evaporator is maintained at greater than 12N.

11. A process as claimed in claim 6, comprising the further steps of compressing a portion of the vapor leaving the absorber and reusing the compressed vapor as steam in said stripping vessel.

12. A process as claimed in claim 6, comprising the further steps of pre-concentrating said volatile acid prior to its delivery to said evaporator, in a second evaporator in which water vapor is produced, and using said water vapor as a supply of steam for said stripping vessel.

13. A process for regeneration of a volatile acid containing metal salt impurities, comprising the steps of:

(a) mixing said volatile acid with sulfuric acid to form an acid mixture;

(b) concentrating the acid mixture in an evaporator to produce a concentrated acid mixture and acid vapor;

(c) condensing said acid vapor to produce a volatile acid solution, and collecting said solution;

(d) feeding the concentrated acid mixture from step (b) to an acid sorption unit in which acid is sorbed from said mixture and metal impurities in the mixture are rejected in a deacidified by-product solution;

(e) eluting acid sorbed in said acid sorption unit with water;

(f) recycling acid eluted from said sorption unit back to said evaporator;

(g) before step (a), pre-concentrating said volatile acid in a second evaporator; and, (h) adding base to said second evaporator to neutralize free acid contained therein.

14. A process for regeneration of a volatile acid containing nitric acid and metal salt impurities, comprising the steps of:

(a) mixing said volatile acid with sulfuric acid to form an acid mixture;

(b) concentrating the acid mixture in an evaporator to produce a concentrated acid mixture and acid vapor;

(c) condensing said vapor to produce a volatile acid solution, and collecting said solution;

(d) feeding the concentrated acid mixture from step (b) to an acid sorption unit in which acid is sorbed from said mixture and metal impurities in the mixture are rejected in a deacidified by-product solution;

(e) eluting acid sorbed in said acid sorption unit with water; and, (f) recycling acid eluted from said sorption unit back to said evaporator;

wherein the acid is sorbed in step (d) by an anion exchanger which has quaternary amine functional groups and demonstrates a higher preference for nitric acid than for sulfuric acid, whereby the ratio of nitrate to sulfate in said by-product solution from said acid sorption unit is less than the ratio of nitrate to sulfate in the solution fed to said sorption unit.

15. A process for regeneration of a volatile acid containing metal salt impurities, comprising the steps of:

(a) mixing said volatile acid with sulfuric acid to form an acid mixture;

(b) concentrating the acid mixture in an evaporator to produce a concentrated acid mixture and acid vapor;

(c) condensing said acid vapor to produce a volatile acid solution, and collecting said solution;

(d) feeding the concentrated acid mixture from step (b) to an acid sorption unit in which acid is sorbed from said mixture and metal impurities in the mixture are rejected in a deacidified by-product solution;

(e) eluting acid sorbed in said acid sorption unit with water; and, (f) recycling acid eluted from said sorption unit back to said evaporator;

wherein the volatile acid is an acid pickling solution contained in a pickle tank, from which spent pickling solution is removed for said regeneration, and wherein said volatile acid solution collected from step (c) is recycled to said pickle tank;

and wherein the process comprises the further steps of: treating said spent pickling solution in a second acid sorption unit prior to step (a), said treatment including sorbing acid from said spent pickling solution and producing a deacidified by-product solution containing said volatile acid and metal salt impurities, which solution is delivered to said evaporator; periodically eluting from said second acid sorption unit a solution a comprising a purified acid product; and recycling said purified acid product to the pickle tank.

* * * * *